US006292949B1

(12) United States Patent
Chang

(10) Patent No.: US 6,292,949 B1
(45) Date of Patent: Sep. 25, 2001

(54) BATH GLOVE

(76) Inventor: Che-Yuan Chang, No. 1, Lane 147, Sec. 2, Chung San Rd., Yun Lin, Chang Hua Hsien (TW)

( * ) Notice: Subject to any disclaimer, the term of this patent is extended or adjusted under 35 U.S.C. 154(b) by 0 days.

(21) Appl. No.: 09/571,723

(22) Filed: May 15, 2000

(30) Foreign Application Priority Data

Mar. 24, 2000 (TW) ..... 89204781

(51) Int. Cl.[7] ..... A41D 19/00
(52) U.S. Cl. ..... 2/159; 15/227
(58) Field of Search ..... 2/16, 20, 158, 2/159, 160, 161.6, 163, 167, 169; 15/227; 66/174

(56) References Cited

U.S. PATENT DOCUMENTS 3,711,889 * 1/1973 Jennings ..... 15/227
4,154,542 * 5/1979 Rasmason ..... 401/7
4,825,499 * 5/1989 Baptiste ..... 15/227
5,134,746 * 8/1992 William ..... 15/227
5,564,154 * 10/1996 Cohn, III ..... 15/227
5,581,809 * 12/1996 Mah ..... 2/20
5,659,899 * 8/1997 Soter et al. ..... 2/160
5,673,435 * 10/1997 Gebhard ..... 2/159
5,711,032 * 1/1998 Carpenter ..... 2/158
6,109,070 * 8/2000 Chen ..... 66/174

* cited by examiner

*Primary Examiner*—John J. Calvert
*Assistant Examiner*—Katherine Moran
(74) *Attorney, Agent, or Firm*—Browdy and Neimark

(57) ABSTRACT

A bath glove comprises a main body and a lashing member. The main body is of a palm-shaped profile and is formed of at least two layers of elastic netted body of a corrugated construction. The lashing member is fastened with an open end of the main body.

1 Claim, 7 Drawing Sheets

BATH GLOVE

FIELD OF THE INVENTION

The present invention relates generally to the bathroom accessories, and more particularly to a bath glove.

BACKGROUND OF THE INVENTION

For ordinary bath cleaning implements, from towels and sponges in the early days to the bath balls and bath gloves in the present days, all of them are developed in the direction of enhancing the cleaning effect and facilitating use. For towels, their surface is relatively rough so that their cleaning effect is quite good. However, as they do not have stretchable resilience, they are not very convenient in use. As for sponges, due to their water-retaining and resilient characteristics, they are preferred over towels. However, as their texture is fine, their cleaning effect is not satisfactory. Bath balls are mostly made from resilient plastic reticulated tubes. Since plastic reticulated tubes have the characteristic of expansion, in general the cleaning effect and water-retaining effect thereof are preferred over towels and sponges. However, they have to be held by hand when in use, which is quite inconvenient. Bath gloves are hence developed for wearing by the user for scrubbing the body.

As shown in FIGS. 1 and 2, there are two main types of bath gloves 1, 2. The bath glove 1 includes a hand-fitting element 3 that is formed by two knitted meshes 4 sewn together. A wrist sleeve 5 is provided at the wrist portion, and is provided with an adhesive fastener 6 thereon to secure the hand-fitting element 3 to the user's palm. Since the hand-fitting element 3 is made up of two knitted meshes 4, it can be cleaned and dried quickly after use for hygienic purposes. However, since the mesh construction thereof is too thin, it is relatively slow to work up a lather with soap or bath gel. Besides, the cleaning effect thereof is inferior to that of bath balls. As for the bath glove 2, it is formed by sewing two single-sides glove portions 7 oppositely. Each single-sided glove portion 7 is formed from nylon filaments, artificial sponge, etc. The construction thereof is relatively thick. Therefore, the speed of working up a lather and the cleaning effect surpass those of the bath glove 1. However, since each single-sided glove portion 7 is formed from nylon filaments, artifical sponge, etc, it cannot be cleaned and dried quickly. Besides, since bathing articles are stored placed in wet bathrooms, mildew can easily breed in the bath glove 2. Hence, the conventional bath glove 2 is not popular among consumers.

SUMMARY OF THE INVENTION

The primary objective of the present invention is to provide a bath glove free from the drawbacks of the conventional bath gloves.

In keeping with the principle of the present invention, the foregoing objective of the present invention is attained by the bath glove which is formed of a main body and a lashing member. The main body is formed of at least two layers of elastic netted body of a corrugated construction. The lashing member comprises a strap fastened with the main body, and a lashing piece disposed on the strap. The main body is used to rub a human body along with the soap suds.

DETAILED DESCRIPTION OF THE INVENTION

Figure 1:
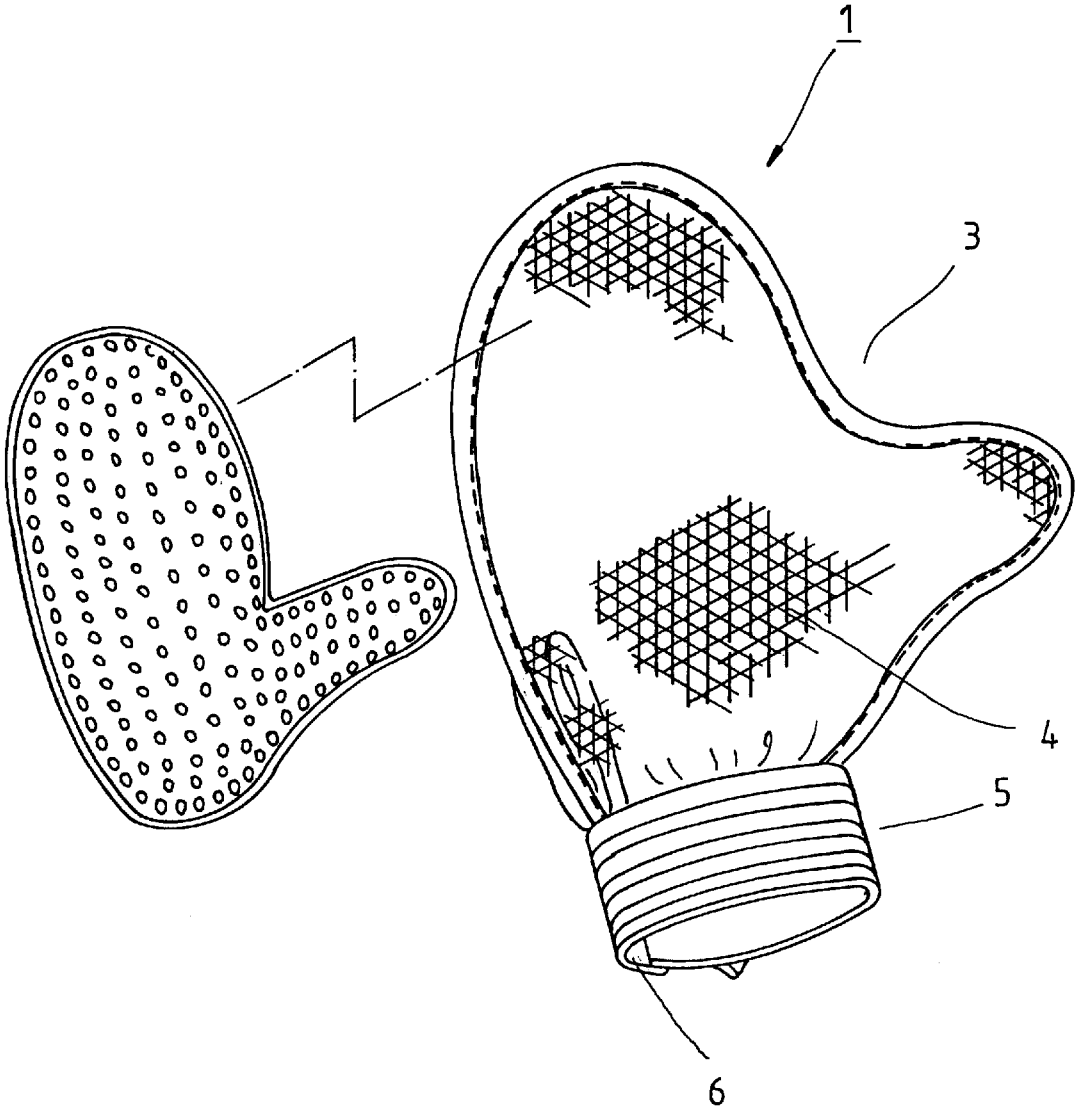
FIG. 1 PRIOR ART
FIGS. 1 and 2 illustrate prior art devices.
Figure 2:
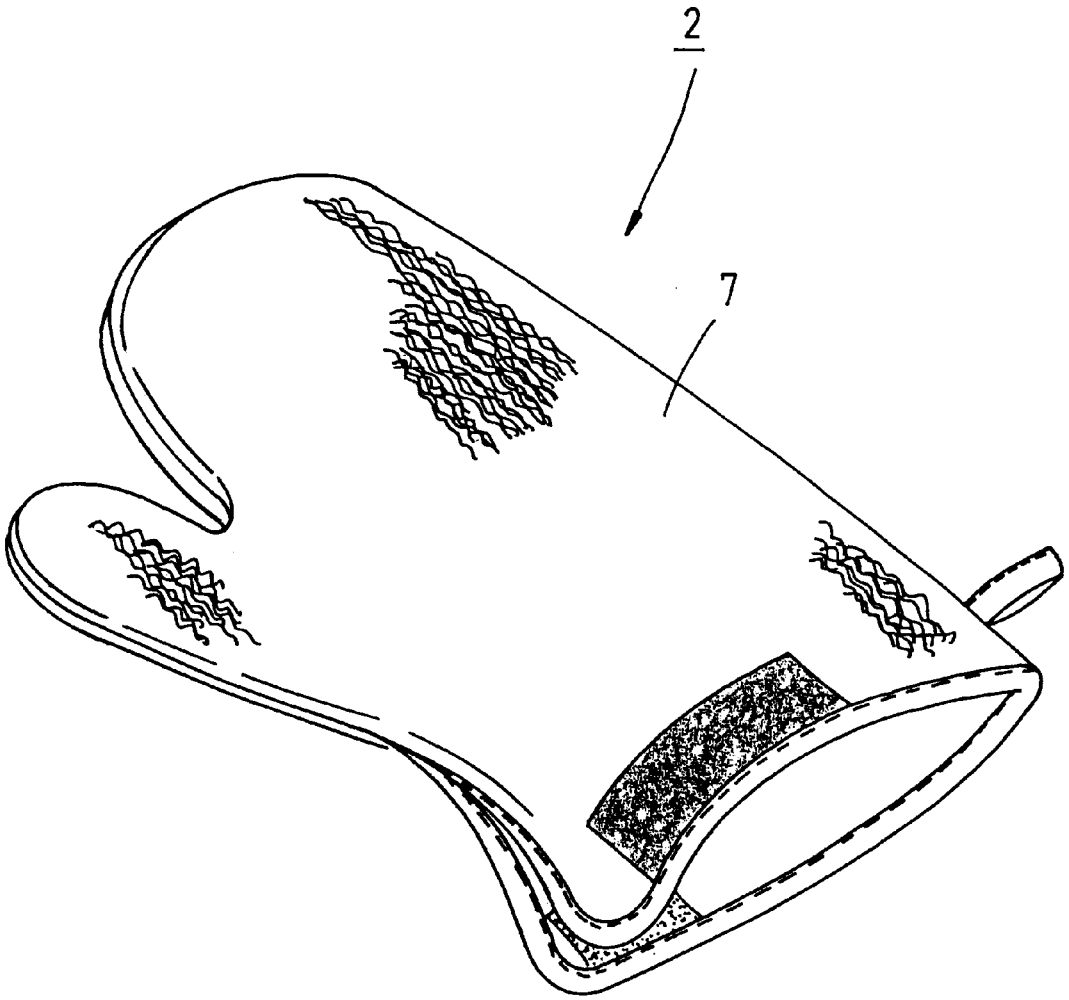
FIG. 2 PRIOR ART
Figure 3:
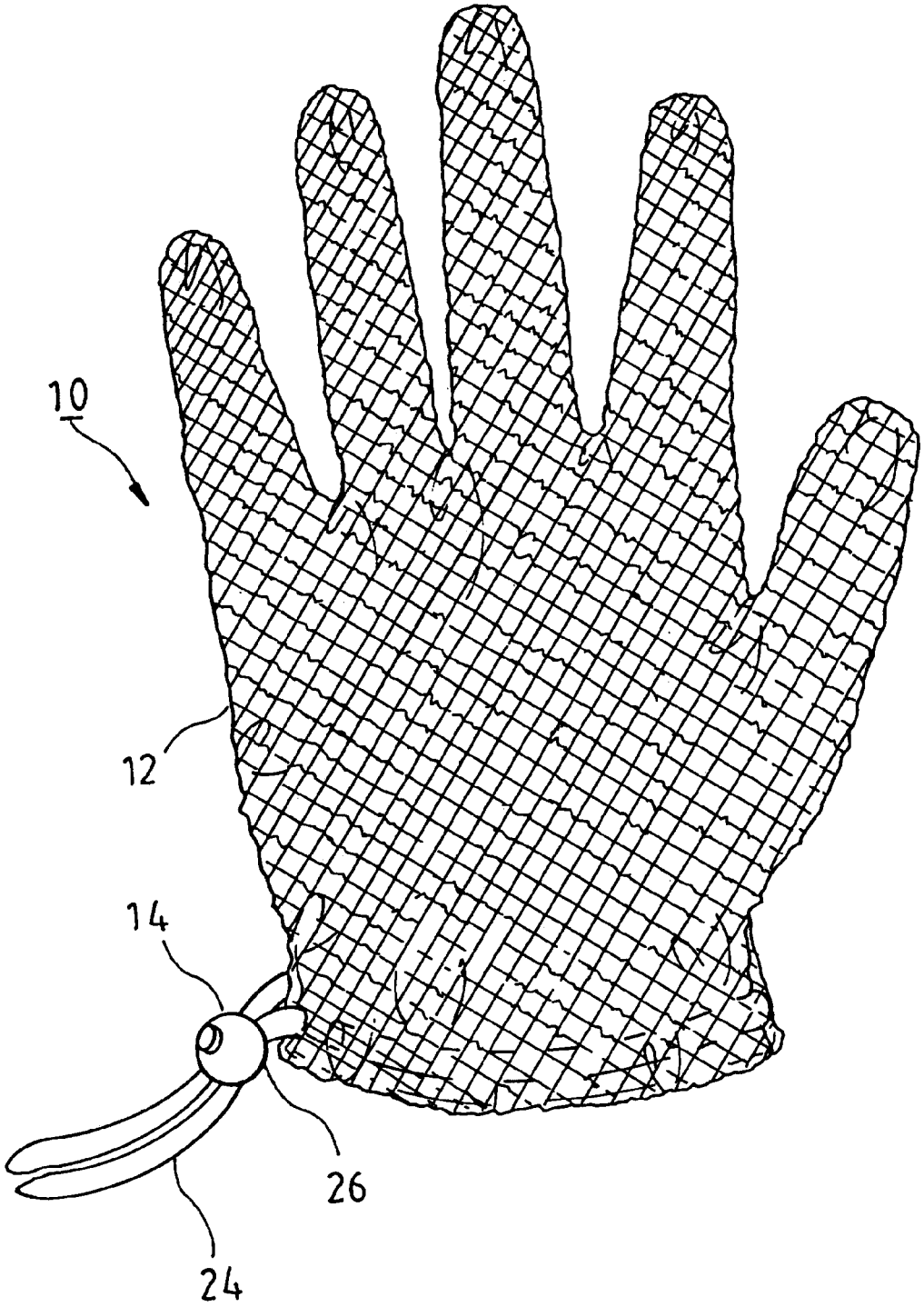
FIG. 3 shows a perspective view of a first preferred embodiment of the present invention.
Figure 4:
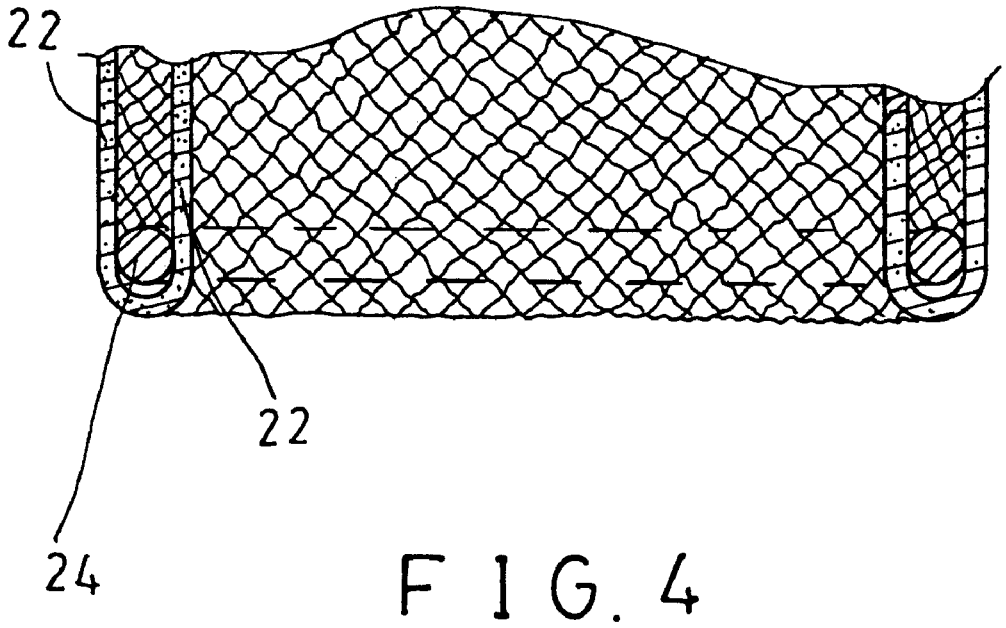
FIG. 4 shows a partial sectional view of the first preferred embodiment of the present invention.

As shown in FIGS. 3 and 4, a bath glove 10 embodied in the present invention is formed of a main body 12 and a lashing member 14.

The main body 12 is formed of two or more layers of elastic netted bodies 22 of a corrugated construction. The main body 12 is made of an elastic netted tube of a plastic material, which is formed into a corrugated structure by a heat rolling device. The corrugated structure is folded such that two open ends of the corrugated structure are superimposed, and that the superimposed area is sewed or molded to have the profile of a palm. The main body 12 is formed by trimming off the excess portion along the margin of the palm. The main body 12 has at least two layers of the elastic netted bodies 22 formed from plastic which produces elastic reticulate surfaces. The lashing member 14 has a strap 24 which is fastened at one end with the inner side of the netted bodies 22. A lashing piece 26 is disposed on the strap 24.

In light reticulate surfaces produced by the of the netted bodies 22 of the main body 12, the bath glove 10 can bring about an effective cleaning of the skin of a user. In addition, the netted bodies 22 of the main body 12 can hold the soap suds longer. The netted bodies 22 is so elastic as to have a soothing effect on the body skin of the user of the bath glove 10. In addition, the bath glove 10 gets dry quickly so as to avert the growth of bacteria or fungi on the bath glove 10. The bath glove 10 is provided with the lashing member 14 for securing the bath glove 10 to the hand of the user.

Figure 5:
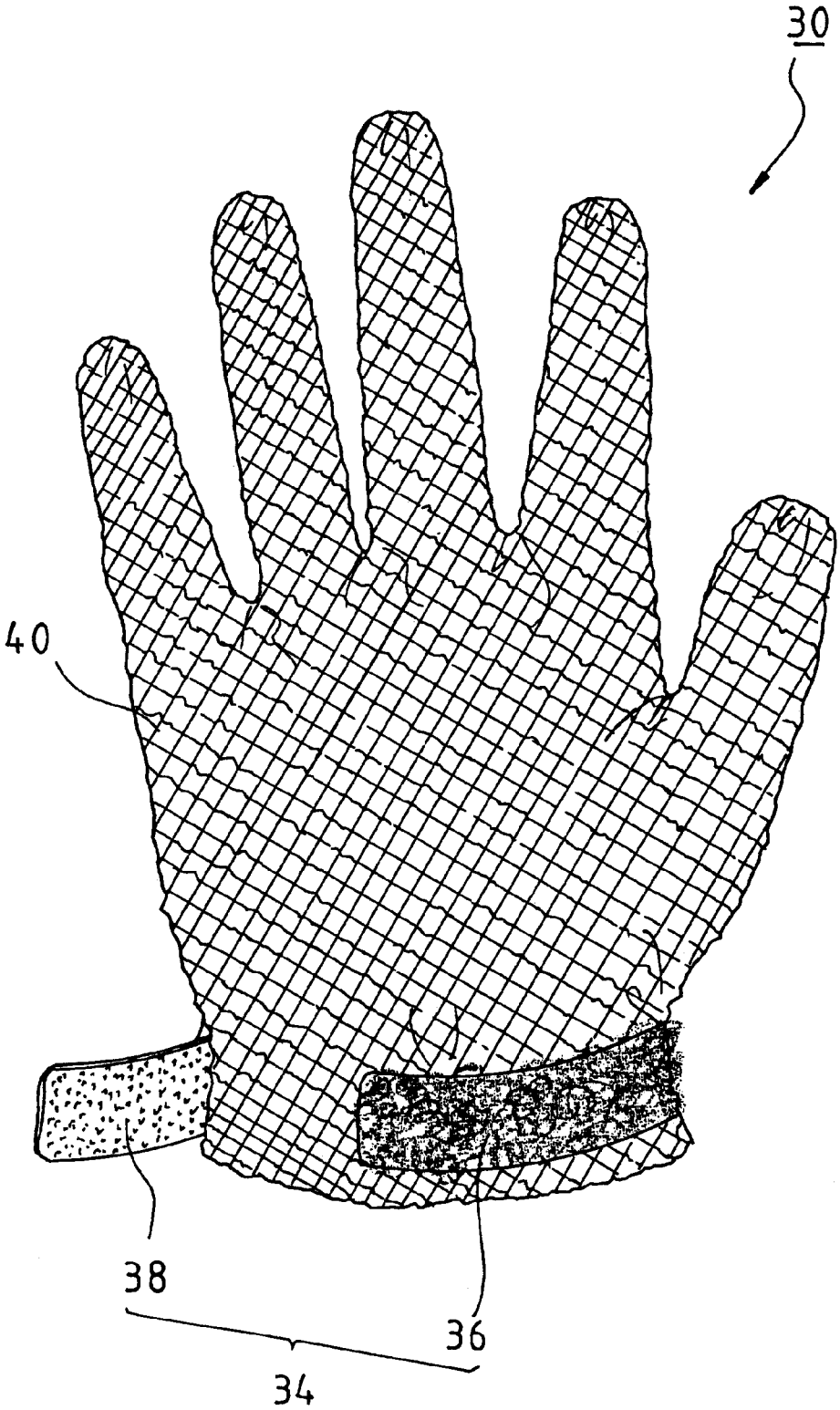
FIG. 5 shows a perspective view of a second preferred embodiment of the present invention.

As shown in FIG. 5, a bath glove 30 of the second preferred embodiment of the present invention is basically similar in construction to the bath glove 10 described above, except that the former has a lashing member 34 which is formed of a female magic tape 36 and a male magic tape 38, which are attached to the open end of the main body 40 by sewing or fusing.

Figure 6:
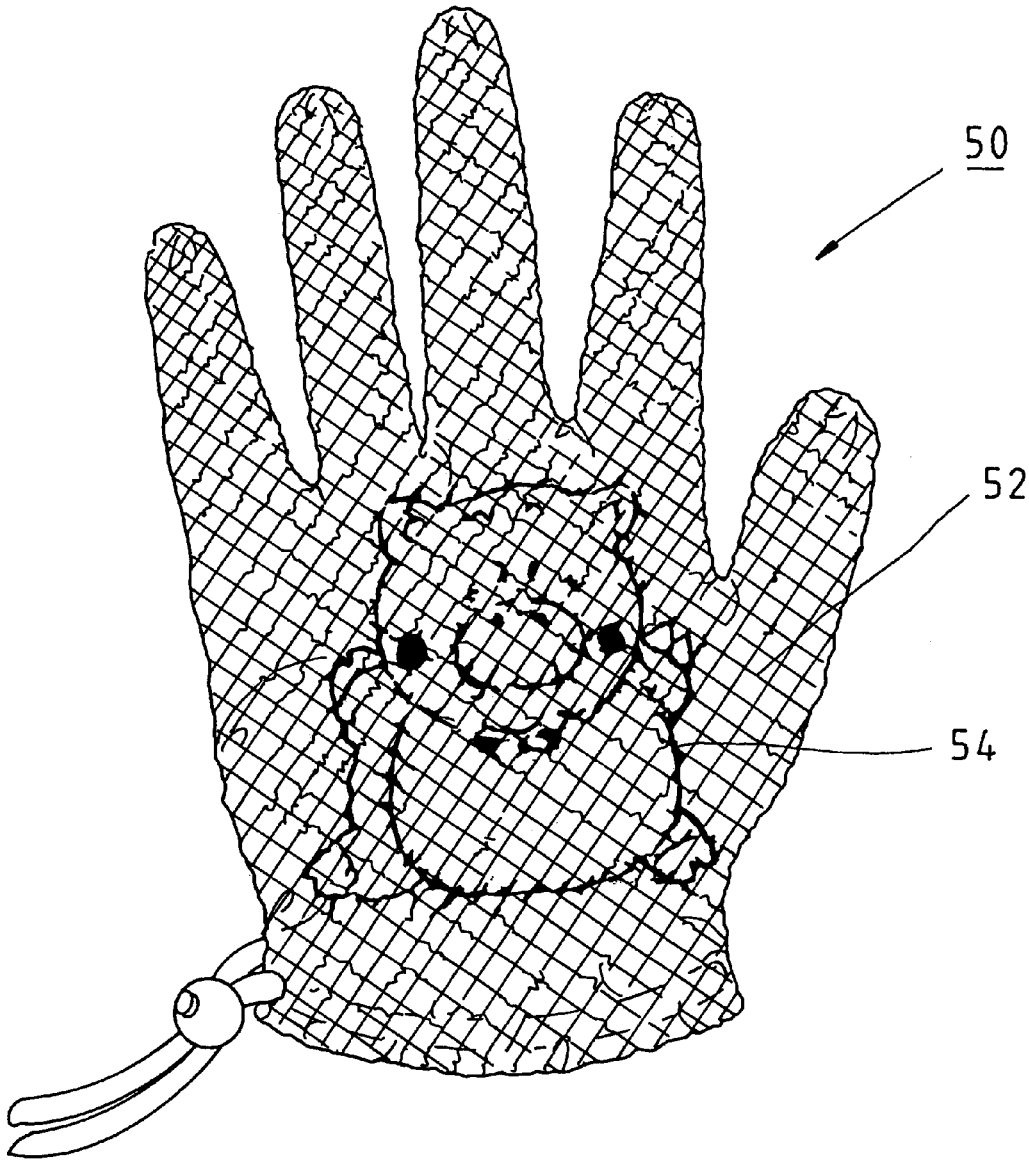
FIG. 6 shows a perspective view of a third embodiment of the present invention.

With reference to FIG. 6 , which shows a further embodiment of a bath glove 50 of the present invention. The surface of a fitting element 52 is formed with a pattern 54 having an undulating cross-section by hot die pressing. In practice, the pattern 54 may be provided on the front or back side of the fitting element 52, or on both. As such, the patterns 54 that have undulating cross-sections can increase the roughness of the surface of the fitting element 52 so that, in use, the bath glove 50 can quickly work up a lather to provide a better cleaning effect.

Figure 7:
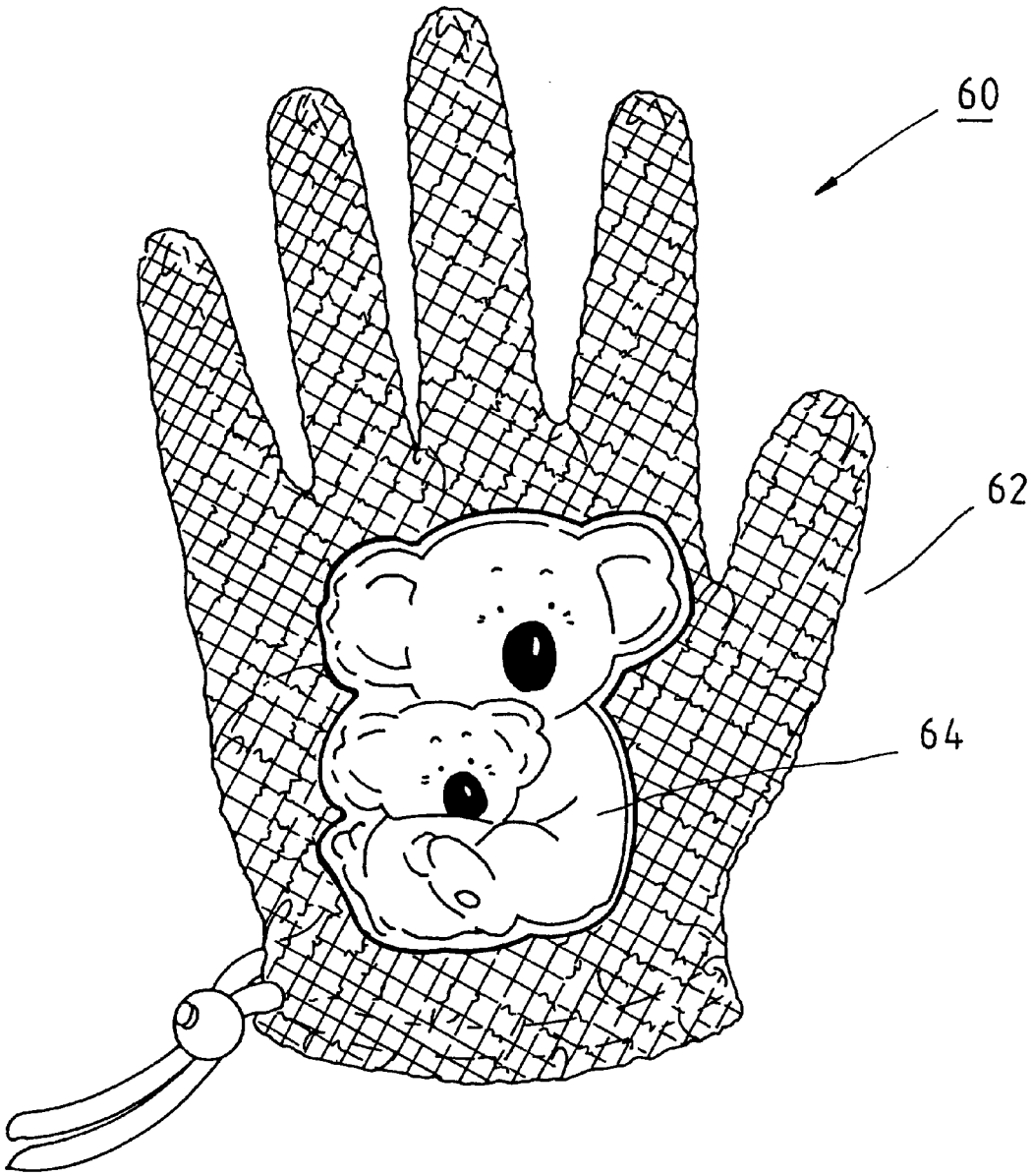
FIG. 7 shows a perspective view of a fourth embodiment of the present invention.

With reference to FIG. 7, which shows still another embodiment of the present invention, the back side of a fitting element 62 of a bath glove 60 has a pattern 64 adhered or sewn thereto to enhance the appearance of the bath glove 60 so as to appeal to children. In addition, the pattern 64 may be words.

What is claimed is:

1. A bath glove comprising a main body and a lashing member, said main body having a palm-shaped profile and formed of at least two layers of elastic netted plastic material of a corrugated construction which produce resilient reticulate surfaces on the main body, said lashing member being fastened with an open end of said main body, wherein said lashing member comprises a strap engaged between the two layers of said main body, and a lashing piece movably disposed on said strap, wherein the elastic reticulate surface of said main body is provided with a plurality of patterns having an undulating cross-section formed by means of hot die pressing.

* * * * *